United States Patent [19]

Ausnit

[11] 4,285,376

[45] Aug. 25, 1981

[54] RECLOSABLE PLASTIC BAG CONSTRUCTION MADE FROM A ONE PIECE EXTRUSION

[75] Inventor: Steven Ausnit, New York, N.Y.

[73] Assignee: Minigrip, Inc., Orangeburg, N.Y.

[21] Appl. No.: 813,450

[22] Filed: Jul. 7, 1977

[51] Int. Cl.[3] ..... B65D 33/02

[52] U.S. Cl. ..... 150/3; 229/55; 229/62

[58] Field of Search ..... 229/55, 64, 62; 150/3

[56] References Cited

U.S. PATENT DOCUMENTS

| | | | |
|---|---|---|---|
| 2,017,838 | 10/1935 | Baker et al. | 229/55 |
| 2,340,546 | 2/1944 | Meaker | 229/55 |
| 2,789,609 | 4/1957 | Post | 150/3 |
| 3,119,549 | 1/1964 | Schoen | 229/62 |
| 3,300,120 | 1/1967 | McColgan | 229/55 |
| 3,473,589 | 10/1969 | Gotz | 229/55 |
| 3,652,006 | 3/1972 | Trewella | 229/55 |
| 3,746,215 | 7/1973 | Ausnit et al. | 150/3 |
| 3,917,160 | 11/1975 | Olerud | 150/3 |
| 3,945,403 | 3/1976 | Nogochi | 150/3 |

*Primary Examiner*—Joseph Man-Fu Moy

*Attorney, Agent, or Firm*—Hill, Van Santen, Steadman, Chiara & Simpson

[57] ABSTRACT

A reclosable bag made from a thin web plastic extrusion has a bag or pouch portion at the top of which an integral return bent gusset provides upwardly projecting multi-ply flanges by which separable resilient zipper-type fastener profiles comprising integral parts of the plastic extrusion are adapted to be pulled apart by pulling the flanges away from one another. The downwardly projecting portion of the gusset initially may provide an unbroken hermetic seal for the bag or pouch. Where preferred the gusset may be of sufficient length relative to the location of the separable resilient fastener to provide an infolded pouring funnel spout after the tip of the spout has been opened and the spout withdrawn or projected from the top opening from the bag. On the other hand, the infolded gusset may serve simply as a hermetic sealing web adapted to be ruptured for discharge of contents from the bag. After opening of the bag, it is adapted to be reclosed by securing the resilient separable fastener profiles together.

7 Claims, 20 Drawing Figures

Fig. 2
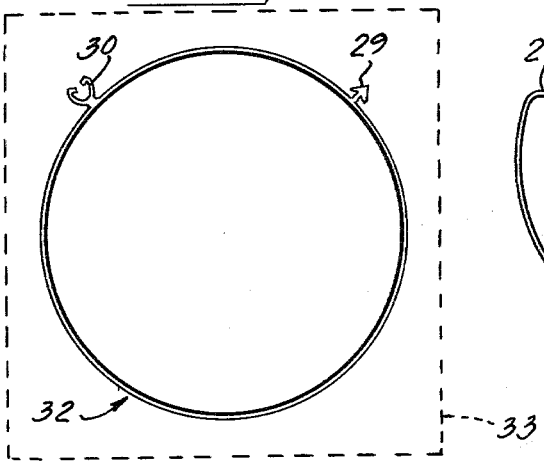
Fig. 3
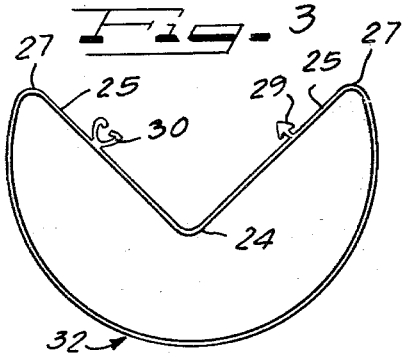
Fig. 1
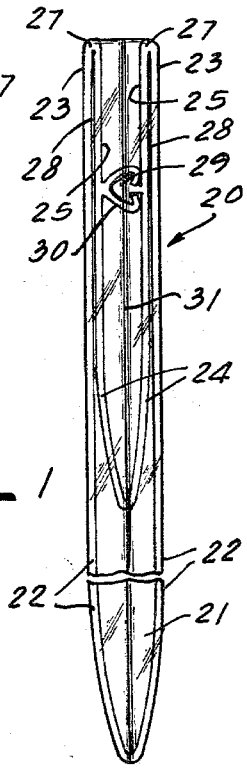
Fig. 4
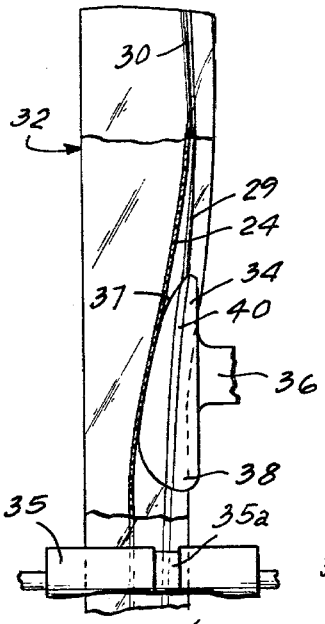
Fig. 5
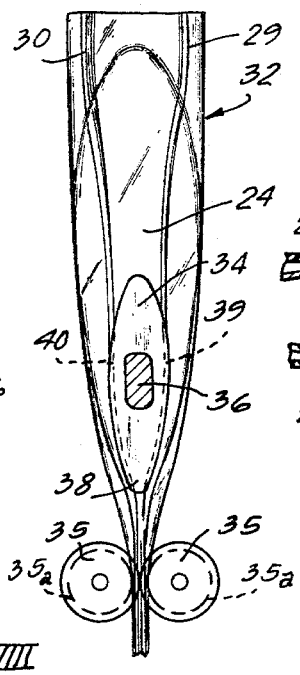
Fig. 7
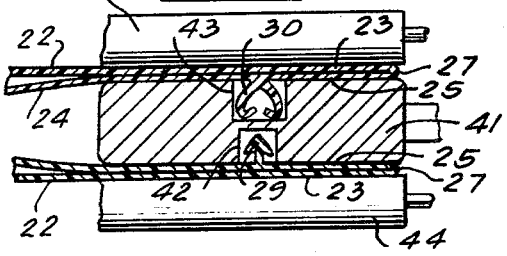
Fig. 8
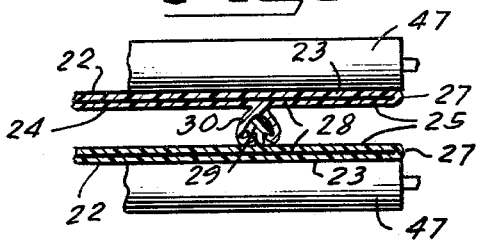
Fig. 6
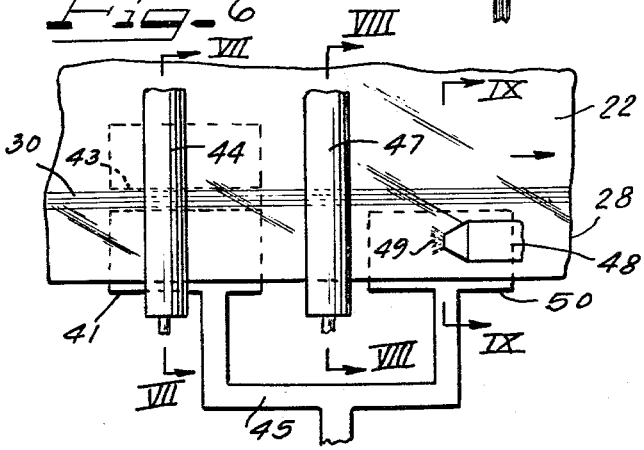
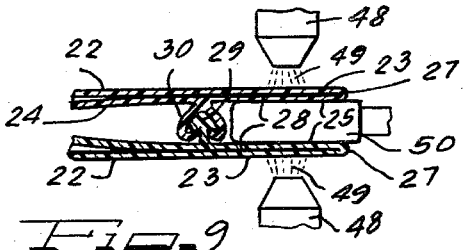
Fig. 9

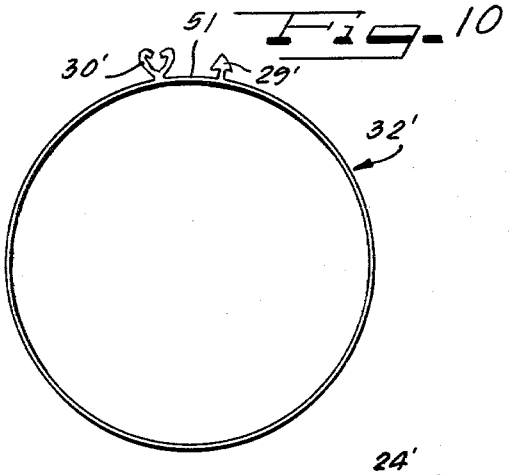
Fig. 10
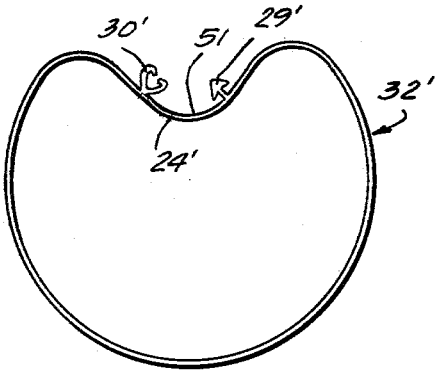
Fig. 11
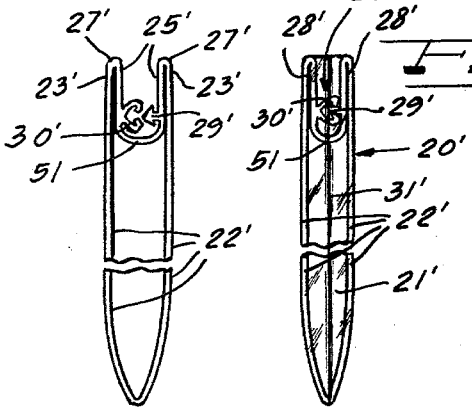
Fig. 12
Fig. 13
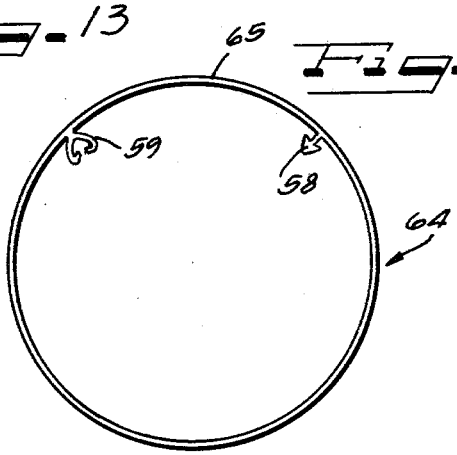
Fig. 14
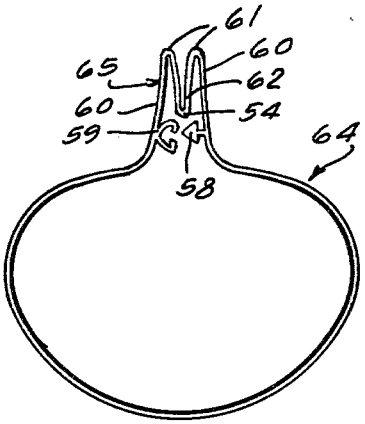
Fig. 15
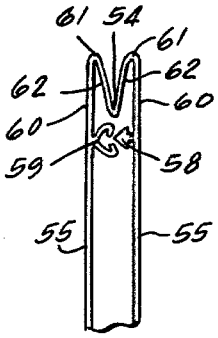
Fig. 16
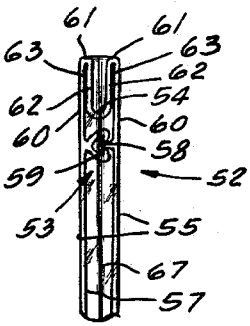
Fig. 17

RECLOSABLE PLASTIC BAG CONSTRUCTION MADE FROM A ONE PIECE EXTRUSION

BACKGROUND OF THE INVENTION

This invention relates to improvements in integral extruded construction for bags, and is more particularly concerned with a construction especially suitable for reclosable bags which are adapted to be initially hermetically sealed and which after being opened are reclosable.

A wide variety of products from foodstuffs to hardware and materials in liquid or granular form are desirably packaged in flexible plastic bags which may or may not be transparent or at least translucent. With certain types of packaged contents, it is desirable to provide means preventing unauthorized access to the contents or to prevent spillage. Often the conents must remain hermetically sealed until used. With pourable contents, whether liquid or particulate, it is often desirable to have the bags equipped with pouring spout means. A type of bag which is especially suitable for these purposes is disclosed in U.S. Pat. No. 3,746,215. However, the bags disclosed therein are constructed from a plurality of separately formed parts secured together. That complicates and increases cost of manufacture because of the multi-part fabrication and the necessary assembling and securing together of the parts.

A principal aim of the present invention is to provide a new and improved, simplified, efficient integral extruded construction by which the bags can be produced in one integral extruded piece. Tubular extrusions for manufacture of bags are disclosed, for example, in U.S. Pat. Nos. 3,246,672, Re.29,208, and 3,380,481. Although those patents disclose the integral extrusion of separable zipper-type resiliently flexible fasteners, they fail to have any provision for a combination closure and hermetic sealing gusset means which may, if desired also provide pouring spout means.

SUMMARY OF THE INVENTION

It is, accordingly, an important object of the present invention to provide a new and improved integral extruded construction for reclosable bags in which by means of a single one piece extrusion not only the bag pouch body and separable fastener means are provided but also an integral infolded hermetic sealing gusset which gusset may also serve as a pouring spout after the bag is opened.

Another object of the invention is to provide a new and improved integral extruded construction which contains in one integral part all of the elements needed for a complete specialized bag structure.

According to features of the invention there is provided a one piece extruded plastic bag construction comprising a body pouch, an infolded closure forming gusset extending into the top of the body pouch, side wall panels defining the body pouch, gusset walls integral at their top edges with the side wall panels and extending inwardly from said top edges and forming with said wall panels double thickness laminar free upper end bag mouth flange extensions on the bag serving as digitally manipulatable bag opening pull flanges, said gusset having a lower closed portion adapted to be severed or punctured to gain access to contents within the bag pouch body, and separable fastener means comprising integral complementary resilient flexible zipper-type fastener profiles comprising integral parts of the plastic extrusion of the bag and located in the vicinity of the gusset and being reclosable after the gusset has been opened.

Other objects, features and advantages of the invention will be readily apparent from the following description of certain representative embodiments thereof, taken in conjunction with the accompanying drawings although variations and modifications may be effected without departing from the spirit and scope of the novel concepts embodied in the disclosure and in which:

BRIEF DESCRIPTION OF THE DRAWINGS

FIG. 1 is a fragmentary vertical end elevational view of an extruded one-piece plastic bag embodying features of the present invention.

FIG. 2 is a schematic illustration of a method of and means for extruding an integral extruded construction or section for bags according to the invention and in this instance comprising a tubular extrusion.

FIG. 3 demonstrates the extrusion of FIG. 2 partially folded.

FIGS. 4 and 5 are schematic illustrations of one method of and means for effecting folding of the extrusion.

FIG. 6 is a fragmentary schematic top plan view of another part of apparatus for making bags according to the present invention.

FIG. 7 is a fragmentary sectional detail view taken substantially along the line VII—VII of FIG. 6.

FIG. 8 is a fragmentary sectional detail view taken substantially along the line VIII—VIII of FIG. 6.

FIG. 9 is a fragmentary sectional detail view taken substantially along the line IX—IX of FIG. 6.

FIG. 10 is an end elevational view of a modified form of the bag extrusion.

FIG. 11 is a view similar to FIG. 10 but showing the extrusion partially collapsed.

FIGS. 12 and 13 show the extrusion of FIGS. 10 and 11 further collapsed toward bag form.

FIG. 14 is an end elevational view of another form of the extrusion for making bags according to the present invention.

FIG. 15 shows the extrusion of FIG. 14 partially collapsed.

FIGS. 16 and 17 show the extrusion of FIGS. 14 and 15 further collapsed toward bag formation.

DESCRIPTION OF PREFERRED EMBODIMENTS

Figure 18:
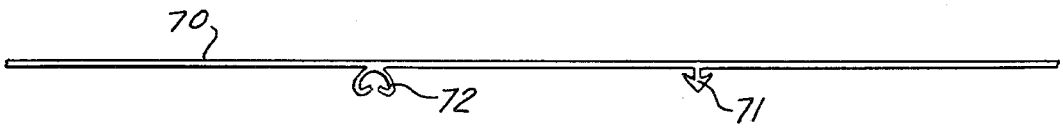
FIG. 18 is an end elevational view of an integral extruded construction or section for bags according to the invention and in this instance comprising an open ended or flat extrusion having the fastener profiles integral therewith.

On reference to FIG. 1, one form of one piece extruded plastic bag 20 embodying features of the invention is depicted comprising a pouch body 21 having coextensive opposite side wall panels 22. Integrally connected with upper mouth end portions 23 of the side wall panels 22 is an inturned security closure gusset 24 having upper end portions 25 which are integrally joined with the upper mouth end portions 23 of the side wall panels along integral fold junctures 27. The gusset wall portions 25 and the side panel portions 23 are of adequate width to provide double thickness flanges 28 at each side of the mouth of the bag and adapted for manipulation to open the bag mouth when desired.

Formed integrally with the bag extrusion, and in this instance integrally on the confronting surfaces of the walls of the gusset 24 at the lower sides of the flange portions 25 are separable fastener means comprising complementary resilient zipper-type fastener profiles comprising a male profile 29 on one side and a female profile 30 on the other side. The profiles 29 and 30 are of any desired form, in this instance comprising a generally arrowhead shaped form for the male profile 29 having opposite lateral shoulders therealong, and a complementary undercut side hook groove recessed form for the female profile 30. Thereby the profiles are adapted to interengage in a locking relation by pushing them together and are adapted to be separated by pulling laterally apart on the manipulatable mouth end pull flanges 28.

As shown, the gusset 24 extends as a generally infolded extension into the bag body 21 extending from the mouth end of the bag and provides an initial closure which may be a hermetic security seal and which is adapted to be punctured or otherwise opened when desired to gain access to contents sealed within the pouch of the bag. In this instance, the gusset 24 is of a length to serve as a pouring spout funnel by reversion of the gusset when the fastener 29,30 is open, for discharge of contents from the bag.

Filling of the bag 20 may be effected in any desired manner, either by inserting contents from one side of the bag before such one side is sealed closed, or by having the lower end of the bag initially open, or slit open for filling the bag from the bottom and then sealing the bottom end of the bag to provide a fully closed bag enclosing the contents. It will be understood that by having the plastic material of the bag of a heat sealable thermoplastic type, as is customary, bags can be produced in continuous succession from a continuous extrusion. Although in the finished bag 20 the laminar wall areas 23 and 25 will be held reasonably close together by the thermally sealed bag side edge seams 31, assurance of laminar integrity may be attained by thermally securing the areas 23 and 25 together to form the flanges 28.

As represented in FIG. 2, an integral extrusion construction 32 for making a succession of the bags 20 is adapted to be formed by extrusion of suitable thermoplastic material, utilizing any preferred extrusion process and equipment, which may conveniently be substantially according to that disclosed in U.S. Pat. No. Re.29,208 the disclosure of which is embodied herein by reference to any extent necessary. According to that patent, extrudate is forced from an extruder, schematically identified at 33 through a suitable annular or other geometric form of die opening to provide a thin wall extruded flexible plastic web which, as shown may be tubular but may also be formed with symmetrically disposed unjoined edges in a flat sheet or strip or other geometric shape wherein the thin wall film or web character of the extruded product is adapted for producing bags 20 in whatever size desired. Where the extruded construction 32 is tubular as shown, the inside of the extruded tube is pressurized by means of air to keep it from collapsing and to obtain cross grain orientation of the material as the extruded shape is cooled and set for further handling. Formed integrally on the extruded web 32 are the longitudinally extending and suitably laterally spaced complementary resiliently flexible fastener profiles 29 and 30. As shown in FIG. 2, the profiles 29 and 30 are integrally attached in one piece to the outer face of the extruded web structure 32. In this instance the spacing between the profiles 29 and 30 is about one-fourth of the circumference of the tubular web 32.

After the extruded construction 32 has been cooled and set sufficiently to be easily handled, the gusset 24 is folded in and the fastener profiles 29,30 closed. By way of example, about one-third of the perimeter of the tubular construction 32 with the profiles 29 and 30 located symmetrically thereon may be folded inwardly as shown in FIG. 3. As will be observed the folding in is started at the fold points 27 sufficiently spaced from respectively the profiles 29 and 30 so that as folding in of the gusset 24 and collapsing of the remainder of the tubular section 32 progresses, the flange areas 25 at the outer sides of the gusset and the corresponding flange areas 23 of the bag side wall panels 22 will be automatically brought into contiguity.

One means for effecting tucking in of the gusset 24 and collapsing of the tubular construction 32 is depicted schematically in FIGS. 4 and 5. For this purpose, a gusset tucking-in head member 34 is located adjacently upstream relative to cooperating rotary pinch rolls 35 to effect progressive folding tucking in of the gusset 24 as the pinch rolls collapse and advance the bag-making one piece extruded web structure and fastener profiles 29,30. In keeping with its tucking-in function, the member 34 is fixedly supported by means of an arm 36 or the like extending from suitable frame structure (not shown) and has a suitably formed shape including a smoothly contoured tucking in edge 37. At its forward end the member 34 tapers to a relatively thin tip 38 consistent with the folded, collapsed condition of the bag section into which the tubular extrusion 32 is forced, by and between the nips of the pinch rolls 35. Along its opposite sides the tucking member 34 has respective longitudinally extending guide grooves 39 and 40 through which the profiles 29 and 30, respectively run during the tucking-in and collapsing operation. These guide grooves 39 and 40 assure that the fastener profiles 29 and 30 will remain in proper opposed relation as the gusset 24 is being tucked in and after the substantially collapsed extrusion section leaves the tucking-in member 34 and passes on through the pinch rolls 35 which have relief grooves **35*a*** to clear the profiles.

After leaving the pinch rolls 35, the collapsed, tucked-in plastic section travels on through additional processing means depicted in FIGS. 6–9, desirably comprising a joining guide block 41 which is received within the tucked in gusset 24 and which has a guide groove 42 on one side through which the fastener profile 29 runs and a guide groove 43 parallel thereto on the opposite side through which the fastener profile 30 runs in the onward travel of the collapsed continuous plastic bag making section. The opposite sides of the guide member 41 are flat and parallel and guide rolls 44 maintain the laminar collapsed bag wall panels 22 and 23 and gusset walls 24 and 25 running in a laminar relation along the flat faces of the guide block member. Support for the guide block member 41 may be provided by means of a supporting frame bracket 45 mounted on the machine frame (not shown).

Downstream adjacent to the guide block 41, cooperating rotary joining rolls 47 press the laminar fastener profile carrying portions of the collapsed extruded section toward one another and snap the fastener profiles 29 and 30 into interlocking relation as viewed in FIG. 8, while maintaining the laminar structure in substantially parallel relation.

Adjacently downstream from the guide rolls 47 means are provided for heat sealing the laminar pull flange areas 23 and 25 together. In a desirable form such heat sealing means comprise hot air nozzles 48 which are directed to impinge hot air jet streams 49 against the outer areas 23 to soften and substantially fuse the areas 23 to the areas 25. The hot air may be supplied from any suitable source. Means which may also be supported by the bracket 45 and comprising an anvil block 50 is disposed between the on-running pull flanges 28 as they are being impinged by the hot air jet streams 49. Not only are the flanges 28 thereby held in proper, efficient position to receive the hot jet streams 49 thereagainst, but by having the anvil 50 located between said flanges, the flanges are prevented from being sealed together. Also by having the anvil 50, if desired, of a good heat transfer material such as aluminum or the like, residual heat in the anvil derived from the jet streams acting on the flanges 28 will preheat the inner flange areas 25 to speed up the fusing action. In effecting the fusing, there need be only sufficient softening at the interface between the flange areas 23 and 25 to effect a reasonable bond so as to maintain the fused laminar relation of the flange areas from spreading open when the bags made from the extruded collapsed process section are filled. Beyond the fusing device 48,50, the completed collapsed extruded plastic bag making section is adapted to be further processed as by transversely sealing and dividing the same into bag sections, filling the bag sections, and sealing either the side opening or bottom opening, as the case may be, after the bag sections have been filled.

In a plastic bag construction where the benefits to be derived from a one piece extruded pilfer-proof, sealed bags are desired without provision for a projectable pouring spout when the bag is opened, the construction depicted in FIGS. 10–13 may be adopted. In this construction the bag 20' has the pouch portion 21' with side wall panels 22' and bag top mouth defining pull flanges 28' formed as lamination of sections 23' and 25' and with the separable fastener profiles 29' and 31' integrally in one piece with and at the inside of the gusset 24', similarly as the corresponding structure in the bag 20 in FIG. 1. However, instead of extending the gusset as a limited secondary pouch inwardly beyond the fastener 29',30', the inner end of the gusset 24' terminates as an integral narrow hermetic sealing web 51 inwardly adjacent to the separable fastener. In use, the sealing web 51 may be completely severed after the separable fastener 29',30' has been opened, or the gusset web 51 may be only partially punctured to provide a pouring spout hole where the contents of the bag are susceptible of being dispensed in that manner. After the bag has been opened it is readily reclosed by reclosing the separable fastener 29',30'. In the method of making the bag 20', substantially similar steps with substantially similar apparatus may be employed as in making the bag 20 of FIG. 1, with such modifications as will produce the structure of the bag 20'. As shown in FIG. 10, a one piece tubular extruded thin web construction 32' having the fastener profiles 29' and 30' integrally in one piece therewith has the fastener profiles 29' and 30' located more closely together, leaving only the relatively narrow gusset area 51 therebetween. Nevertheless, when the gusset 24' is tucked in as shown in FIG. 11, the connecting sealing area 51 and the profiles 29' and 30' are tucked down deep enough into the gusset 24' to provide adequate length in the pull flanges 28' as formation of the bag section progresses from the preliminary tucking indentation of the gusset 24' as shown in FIG. 11 to the more advanced tucking in of the gusset and collapsing of the side wall panel portions 22' as in FIG. 12. Completion of the bag section to the fully collapsed fastener closed and pull flange fused condition as represented in FIG. 13 may all be effected in similar manner with similar apparatus as described in connection with FIGS. 4–9, except that in the final formation only the narrow connecting sealing web 51 will be present at the inner side of the separable fastener 29',30'. While FIG. 10 shows a tubular construction, a flat sheet or strip construction as shown in FIG. 18 can be used just as readily.

In another form as depicted in FIGS. 14–17, a one piece flexible plastic bag 52 is provided which has substantially the same attributes as the bags 20 and 20' already described, except that instead of a resiliently flexible separable zipper-type fastener assembly 29',30' being formed integrally with a tucked in mouth end gusset 51 of the bag 20', the separable fastener assembly is formed in the vicinity of and below, the gusset 54 but separate therefrom and on the inner sides of side wall panels 55 defining a pouch body 57 for the bag 52. As will be observed, a male fastener profile 58 is provided integrally in one piece on one of the side wall panels 55 and a complementary female fastener profile 59 is formed integrally in one piece on the other of the side wall panels 55. In this construction the inner end of the tucked in gusset 54 terminates adjacent to and above the fastener 58,59. However, similarly as in the previously described forms of the bag, adequate width mouth end flange portions 60 of the side wall panels 55 extend beyond the fastener 58,59 and join along integral junctures 61 with side panels 62 of the gusset 54 to provide pull flanges 63 at each side of the mouth of the bag. If preferred, the flange areas 60 and 62 may be fused, although if preferred, they may remain unfused so that after puncturing the gusset 54 to open the bag, the gusset may be projected as a pouring spout or funnel which is adapted to be tucked back into the bag mouth similarly as the funnel extension of the tucked in gusset 24 in FIG. 1 except that the gusset 54 extends inwardly toward the separable fastener 58,59 instead of the funnel portion of the gusset extending inwardly beyond the fastener 29,30 in FIG. 1.

In making the bag 52, a one piece extruded thin plastic web and fastener profile structure 64 may be formed as shown by tubular extrusion or if so desired by flat sheet extrusion with the fastener profiels 58 and 59 suitably spaced apart to provide suitable area 65 of the extruded web between the profiles 58 and 59 to provide the gusset 54 and the pull flanges 63 in the completed bag. As shown in FIG. 15, the area 65 is adapted to be collapsed with the gusset 54 tucked in between the flange areas 60 and the profiles 58 and 59 brought into alignment adjacent to the inner end of the gusset 54. Then, the remainder of the extrusion 64 is adapted to be collapsed to provide the wall panels 55. After the fastener profiles 58 and 59 have been snapped into interlocking relation, the panel areas forming the pull flanges 63 may be fused if desired, although they may be left unfused if it is desired to have a projectable pouring spout funnel arrangement. After the one piece extruded bag section has been completed, it may be sealed and separated along transverse lines 67 to provide sealed bag sides and the bags filled in any preferred manner either while one side is still open or by slitting the bottom ends of the bag and filling them from the botton ends and then sealing up the bottom ends.

Figure 19:
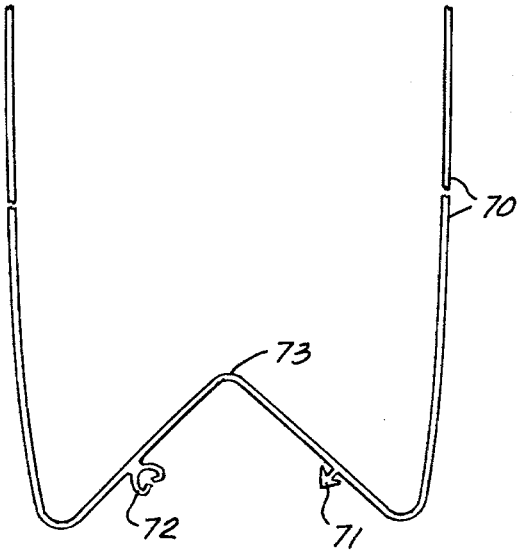
FIG. 19 demonstrates the extrusion of FIG. 18 partially folded.
Figure 20:
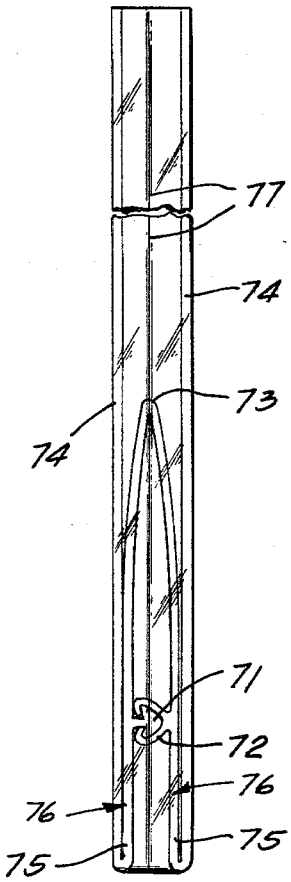
FIG. 20 shows the extrusion of FIGS. 18 and 19 collapsed and the fastener profiles interlocked.

FIGS. 18–20 depict an arrangement wherein a one piece flat thin extruded plastic web 70, of adequate width to provide the size bags desired, is provided with an integral male separable fastener profile 71 and a complementary female fastener profile 72, the profiles being spaced adequately apart to permit, as shown in FIG. 19, folding of the area between the profiles 71 and 72 into a gusset 73. When the profiles 71 and 72 are brought together as shown in FIG. 20 into interlocked fastener relationship, the gusset 73 extends inwardly between bag wall panels 74, and substantial width areas of the panels 74 and flange portions 75 which project outwardly from the profiles 71 and 72 cooperate to provide laminar pull flanges 76. With this form of construction, after the continuous strip has been folded up as shown in FIG. 20 and sealed along transverse lines 77 to provide a bag section, contents may be loaded into the bag section through the open end where the free ends of the original plastic sheet have been brought together but left unsealed until the contents have been loaded into the bag. Thereafter the open bottom end of the bag is adapted to be sealed closed in well-known manner to confine the contents securely within the sealed bag.

In all forms of the invention disclosed, the bags are provided with integral laminar pull flanges at the mouth ends of the bags, with a tucked in gusset initially sealing the mouth end of the bag and after opening of the bags serving as pouring spout means if desired. The bags are in every instance reclosable by means of the resiliently flexible integral separable fastener in the vicinity of the mouth end gusset.

It will be understood that variations and modifications may be effected without departing from the spirit and scope of the novel concepts of this invention.

I claim as my invention:

1. A plastic bag construction made from a one piece extrusion, comprising:
   - a pouch body;
   - an infolded security closure forming a gusset extending into the top of the pouch body;
   - side wall panels defining the pouch body;
   - gusset walls integral in one piece at their top edges with the side wall panels and extending folded inwardly from said top edges and forming with said wall panels double thickness free upper end bag mouth flange extensions on the bag serving as digitally manipulatable bag opening pull flanges;
   - said gusset providing a seal for the bag mouth and having a lower closed portion adapted to be severed or punctured to open the gusset to gain access to contents within the bag body pouch;
   - and separable fastener means comprising complementary flexible fastener profiles which are integral parts of said extrusion located inwardly from said double thickness free upper end bag mouth flange extensions and adjacent to the gusset, said profiles being separable by pulling said upper thickness bag mouth flange extensions apart and being reclosable to seal the bag after the gusset has been opened;
   - said fastener profiles being formed integrally on said gusset walls.

2. A construction according to claim 1, wherein said gusset projects inwardly into the bag body pouch a substantial distance below the closure profiles.

3. A construction according to claim 1, wherein said gusset terminates as a narrow closure web contiguously adjacent to the inner sides of the closure profiles.

4. A bag construction according to claim 1, wherein said extrusion is originally tubular with said separable fastener profiles extruded in one piece therewith at spaced parallel locations on the extrusion, and the extrusion is collapsed to form said pouch body and gusset and to effect closing interconnection of said profiles.

5. A bag construction according to claim 1, wherein said extrusion is originally a flat sheet with said separable fastener profiles extruded in one piece therewith at spaced parallel locations on the extrusion, and the extrusion is collapsed to form said pouch body and gusset and to effect closing interconnection of said profiles.

6. A bag construction according to claim 1, including means for securing said side wall panels and gusset walls in double thickness free upper end bag mouth flange extensions.

7. A plastic bag construction made from a one piece extrusion, comprising:
   - a pouch body;
   - an infolded security closure forming a gusset extending into the top of the pouch body;
   - side wall panels defining the pouch body;
   - gusset walls integral in one piece at their top edges with the side wall panels and extending folded inwardly from said top edges and forming with said wall panels double thickness free upper end bag mouth flange extensions on the bag serving as digitally manipulatable bag opening pull flanges;
   - said gusset providing a seal for the bag mouth and having a lower closed portion adapted to be severed or punctured to open the gusset to gain access to contents within the bag body pouch;
   - and separable fastener means comprising complementary flexible fastener profiles which are integral parts of said extrusion located inwardly from said double thickness free upper end bag mouth flange extensions and adjacent to the gusset, said profiles being separable by pulling said upper thickness bag mouth flange extensions apart and being reclosable to seal the bag after the gusset has been opened;
   - said fastener profiles being integral with the side wall panels and located close to the inner end of the gusset.

* * * * *